US005394942A

United States Patent [19]

Catania et al.

[11] Patent Number: 5,394,942

[45] Date of Patent: Mar. 7, 1995

[54] METHOD FOR STIMULATION OF LIQUID FLOW IN A WELL

[75] Inventors: Steven M. Catania; Christopher L. Catania, both of Newburgh, N.Y.

[73] Assignee: Aqua Freed of New York, Inc., Newburgh, N.Y.

[21] Appl. No.: 147,146

[22] Filed: Nov. 2, 1993

[51] Int. Cl.[6] ..... E21B 36/00; E21B 37/00; E21B 43/27

[52] U.S. Cl. ..... 166/302; 166/307; 166/312

[58] Field of Search ..... 166/302, 307, 308, 311, 166/312

[56] References Cited

U.S. PATENT DOCUMENTS

| | | | |
|---|---|---|---|
| 1,843,002 | 1/1932 | Small | 166/302 X |
| 3,076,762 | 2/1963 | Dill | 166/302 X |
| 3,386,511 | 6/1968 | Messina | 166/302 X |
| 4,250,965 | 2/1981 | Wiseman, Jr. | 166/302 X |
| 4,534,413 | 8/1985 | Jaworowsky | 166/302 |
| 5,261,490 | 11/1993 | Ebinuma | 166/302 X |

*Primary Examiner*—George A. Suchfield

[57] ABSTRACT

A method of stimulating a flow of water into a well from water pools in strata surrounding the well. The well is sealed in a manner such that pressurization of the well can be accomplished. Liquified carbon dioxide is introduced into the well at a down hole pressure such that the liquified carbon dioxide solidifies within the well forming solid carbon dioxide and introduction of the solid carbon dioxide is continued into the well until a desired level of filling of the well is attained. The sealed well containing solid carbon dioxide is allowed to stand for a time sufficient to sublime the solid carbon dioxide contained in the sealed well and the residual pressure is released in the sealed well and the seal removed from the well.

9 Claims, 3 Drawing Sheets

METHOD FOR STIMULATION OF LIQUID FLOW IN A WELL

BACKGROUND OF THE INVENTION

1. Field of the Invention

The invention is directed to the field of water wells, monitor wells and recovery wells for recovering contaminated ground water. In particular, the present invention relates the stimulation of liquid flow into a well from liquid in the strata about the well. Additionally, the present invention relates to removing mineral scaling in the well and formation and to the control of common bacteria, especially, iron-related bacteria that plug up wells.

2. Description of the Prior Art

The prior art techniques for stimulating the flow of water in a dry well or one providing insufficient water often involved drilling the well deeper, drilling shafts transverse to the main well shaft or dynamiting the well in the hope of creating fissures in the strata to provide passages to water supplies. Dynamiting more often than not will destroy the well. Other prior art techniques employed treating agents pumped into the well such as inorganic acids, for example hydrochloric acid, sulfuric acid, nitric acid and hydrofluoric acid, some organic acids forming water soluble salts, for example oxalic acid and acetic acid. Solvents, especially organic solvents, for instance alcohols, hydrocarbons and chlorinated hydrocarbons are also useful as are oxidizing agents such as potassium permangenate, hydrogen peroxide, oxygen and substance yielding oxygen. These techniques are extremely useful in the rehabilitation of oil or gas wells but are not directly useful where potable water is required, since these materials act as water pollutants which must be removed or treated before the water from the well can be used.

An apparatus and method for water flow stimulation in a well is disclosed in U.S. Pat. No. 4,534,413 and U.S. Pat. No. 4,580,629 (the disclosures of these references are incorporated herein by reference). The apparatus disclosed in these patents includes two plates proportioned to be received in a well casing and which were connected by tie rods. A third plate, known as a pressure plate, is located between the tie rod connected plates and a deformable gasket located between the pressure plate and the lower of the two tie rod connected plates acts as the means for sealing the cap in the well. Sealing in the well is accomplished by moving the pressure plate downward toward the lower of the tie rod connected plates.

The embodiments disclosed in these patents provide a relatively simple, direct manner of stimulating the flow or water from water supplies trapped in the strata about a well shaft into such shaft without adversely affecting the potability of the water released. A strong cap is fitted to the well casing to prevent its unwanted removal therefrom and to provide a seal therebetween so that the pressure on the well can be maintained. The cap is provided with fittings to control the introduction of liquid or gaseous nitrogen and liquid or gaseous carbon dioxide into the well and to control the pressure of the gases produced when the liquids go into their gaseous states. The well pressure control also permits the well gas pressure to be reduced to atmospheric pressure as desired. The liquid or gaseous nitrogen and liquid or gaseous carbon dioxide can be introduced into the well individually or jointly. The liquid nitrogen and liquid carbon dioxide are introduced into the well and upon evaporation lower the temperature of the surrounding strata, by absorbing heat therefrom, to a temperature below the freezing point of water thereby freezing the water present in the strata and causing fractures. The liquids are introduced into the well and the resulting gases are retained under desired pressure levels causing the gases to freeze water or water impregnated soil, sand or rock in the wall and thereby expand the fracture. The subsequent release of the well pressure permits the water trapped behind the fractured material to pass into the well under its own pressure. The procedure can be repeated a plurality of times until the flow of water into the well is sufficient. It is therefore an object of this invention to provide a novel method of stimulating water flow into a dry water well or one with low water flow into it.

In commonly assigned U.S. Ser. No. 07/905,793 filed Jun. 29, 1992, now abandoned, an apparatus is disclosed which provides a relatively simple, direct manner of stimulating the flow of liquid from liquid supplies trapped in the strata about a well shaft into such shaft without adversely affecting the potability of the water released. A well cap is fitted to the well casing and/or well screen or the surrounding soil and/or rock walls of the well to prevent unwanted removal of the apparatus therefrom and to provide a seal therebetween so that the pressure on the well can be maintained.

The cap is provided with fittings to control the introduction of liquid or gaseous nitrogen and liquid or gaseous carbon dioxide into the well and to control the pressure of the gases produced when the liquids go into their gaseous states. The well pressure control also permits the well gas pressure to be reduced to atmospheric pressure as desired. The liquid or gaseous nitrogen and liquid or gaseous carbon dioxide can be introduced into the well individually or jointly.

The well cap of this application has a first and second plate means which are so proportioned as to be receivable in a well casing or in the surrounding well walls. A sealing means which extends between the first and second plate means can be actuated by downward movement of the first plate means toward the second plate means which is mounted at the bottom by means of a hydraulic cylinder.

Mounted between pressure plates is a neoprene gasket which is approximately the same width as the plates. When acted upon by piston or plunger, the neoprene gasket trapped between plunger and lower pressure plate is caused to expand outwardly and the grip of the walls of well. The engagement between the periphery of the neoprene gasket and the walls of well serves to hold the position of cap at the desired depth in the well and to seal the well at such depth.

The above-mentioned U.S. patents and patent application are incorporated by reference in total into the present application.

It is another object of these patents to provide a novel method of stimulating water flow into a water well without affecting the quality of the water.

It is another object of these patents to provide a novel method of stimulating water flow into a water well employing solid carbon dioxide.

A further object of this invention is to provide a novel method which can easily be used to control bacteria in a well.

A still further object of this invention is to provide a novel method which can be employed for removing mineral scaling in a well.

The above objects are accomplished by the novel method of the present invention.

SUMMARY OF THE INVENTION

The embodiments disclosed herein provide a relatively simple, direct new and improved manner of stimulating the flow of water from water supplies trapped in the strata about a well shaft into such shaft without adversely affecting the potability of the water released. A seal is fitted to the well casing or to the well to prevent its unwanted removal therefrom and to provide a seal therebetween so that the pressure on the well can be maintained. The seal can be provided with fittings to control the introduction of liquid or gaseous carbon dioxide into the well and to control the pressure.

The pressure in the well is regulated to a desired level and liquid $CO_2$ is introduced in the well. The pressure is regulated to such a level that the liquid $CO_2$ upon entering the sealed well rapidly solidifies within the well. Liquid $CO_2$ addition is continued until the well is filled with solid $CO_2$. The solid sealed $CO_2$-filled well is allowed to sit and the solid $CO_2$ gradually sublimes. After the solid $CO_2$ sublimation is completed any residual pressure in the well is released and the well is unsealed. If desired, the process may be repeated.

FIG. *7a* and *7b* show a fragmentary schematic side elevation of a sixth type of water well.

DETAILED DESCRIPTION OF THE FIGURES

Figure 1:
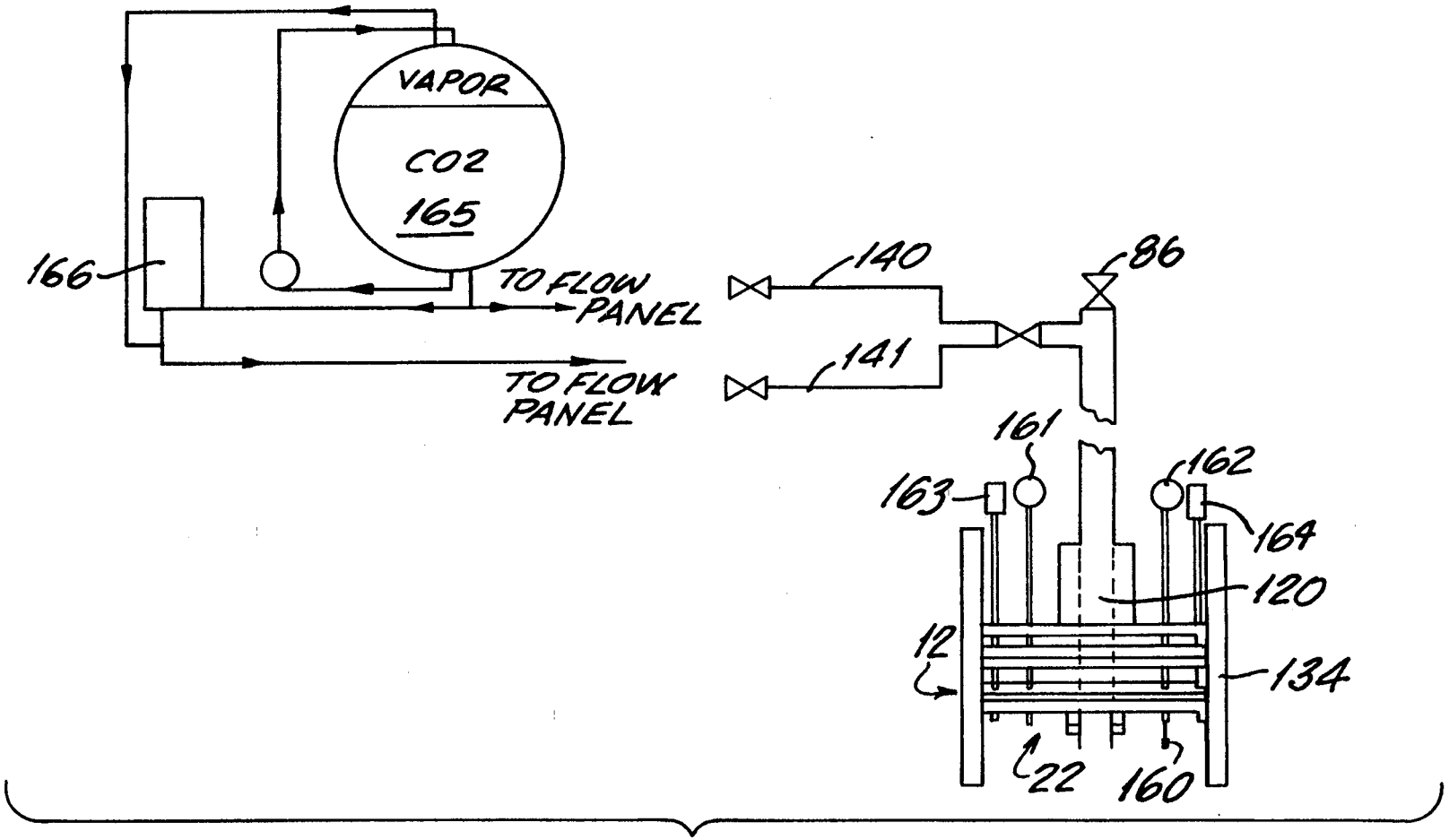
FIG. 1 is diagrammatic view of the apparatus utilized in the present method.

The apparatus 10 which can generally be employed in carrying out the present method is shown in FIG. 1. The well is sealed in order to allow pressurization thereof by a well cap 120 which is placed on the well casing 12. Temperature probe 160 is provided to indicate the down hole temperature on gauge 162. A pressure gauge 161 is also provided in order to indicate the down hole pressure. A preset safety valve acts to regulate the down hole pressure. Rupture diaphragm 164 is provided and is set at a slightly higher pressure in psi setting to ensure containment of the well seal in the event that safety valve 163 is defective or rendered in operable.

Gaseous carbon dioxide is discharged from the $CO_2$ storage vessel 165 either from the vapor space of the vessel or from the vaporizer 166 and placed in the well 22 through a high pressure hose 140 to assure that all water is displaced from the transport lines as well as the area immediately below the well seal. Liquid carbon dioxide is introduced into the well from the vessel through high pressure hose 141. The pressure directly below the well seal is regulated to a level such that liquid $CO_2$ entering the sealed well will rapidly solidify upon entry into the sealed well. Preferably this pressure is regulated to be between about 0 and 70 PSI. The temperature of the liquid carbon dioxide is now approximately −110 degrees fahrenheit.

Liquid introduction and solid $CO_2$ formation is continued until the well 22 is filled with solid $CO_2$. The addition of liquid $CO_2$ at very low temperature and the presence of the solid $CO_2$ in the well 22 as well as sublimed $CO_2$ vapor will reduce the temperature therein and cause freezing within the well and the well formation.

The temperature in the surrounding formation being greater than the temperature of the solid $CO_2$ will cause the solid carbon dioxide to sublime. The solid $CO_2$ will gradually vaporize generating adequate pressure and time-releasing carbonic acid into the surrounding strata. By repeating the process, the well can be refilled in the open area with solid carbon dioxide thereby further lowering the temperature of the surrounding strata as well as the water in the formation to cause the water to freeze and expand. The freezing of the water within the formation removes scale and mineral encrustation in the well and acts as a bactericide to kill bacterial growth well into the formation.

After the well 22 is filled with solid $CO_2$ and the solid $CO_2$ sublimes, the remaining residual pressure within the well 22 can be released and the seal 120 removed. The waterflow in the well has now been stimulated and bacteria within the well controlled.

Figure 2:
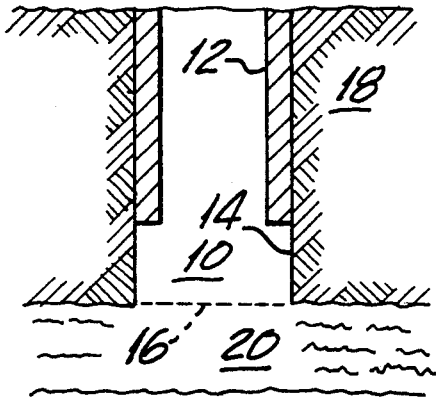
FIG. 2 is a fragmentary schematic side elevation of a first type of water well.

Turning now to FIGS. 2 to 5 there are shown schematic side elevational views of three generalized types of wells and their surrounding soil, rock and water formations with respect to well casing 12. As the well 10 is drilled, a metal well casing 12 is inserted into at least the upper portion of the well to prevent collapse of the well and the undermining of the adjacent soil. The depth of the casing 12 is selected in accordance with the type of substrate through which the well is being drilled and in accordance with applicable local law. In general, the casing 12 is about 50 feet in a domestic water well. If desirable or necessary, the walls of the lower part of the well may be partially cemented, bricked, etc. Water enters the well 10 through the side walls 14 or the open bottom 16, presuming the side walls 14 and the bottom 16 are porous enough to permit the passage of water therethrough and into the well 10. FIG. 2 shows the ideal type of arrangement wherein well 10 is sunk through a rock and soil strata 18 to emerge into an aquifer of water 20 such as an underground spring. Such a well 10 could easily be expected to provide a continuous supply of water at the rate of about 1 to 5 gallons per minute. If sufficient hydrostatic pressure or head is not present to force the water out of well 10 to its desired location a submersible pump (not shown) of the type well known in the art can be used to pump the water from well 10.

Figure 3:
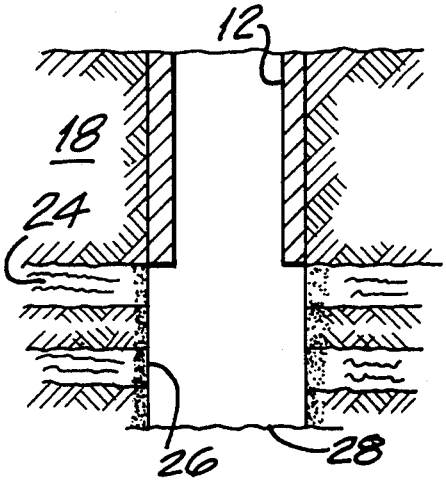
FIG. 3 is a fragmentary schematic side elevation of a second type of water well.

FIG. 3 illustrates a well 22 drilled through a rock and soil strata 18 into a water bearing sand aquifer 24. Water is able to pass through the side walls 26 and bottom 28 into the interior of well 22 at a rather slow rate. However, upon aging the water flow rate will be reduced depending upon the quality of the water.

Figure 4:
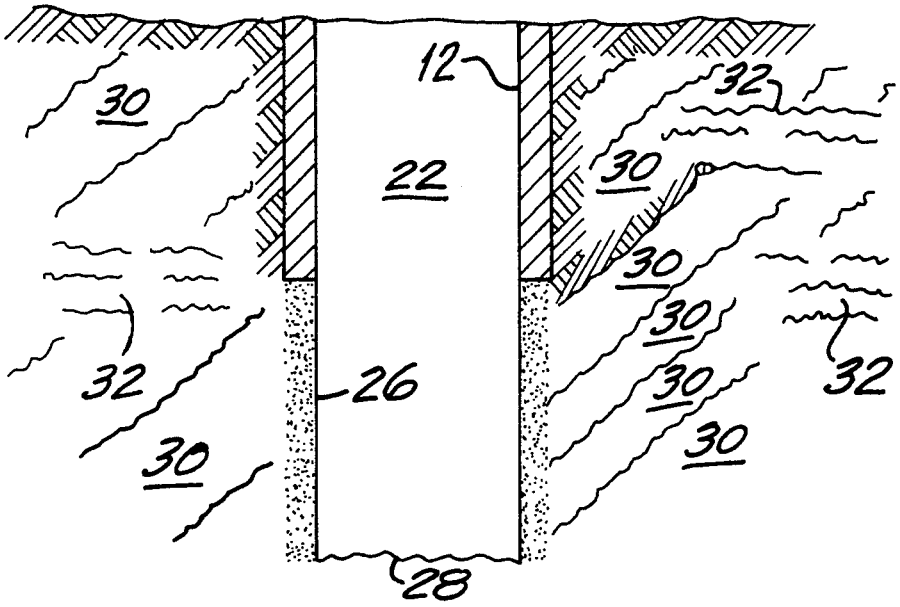
FIG. 4 is a fragmentary schematic side elevation of a third type of water well.
Figure 5:
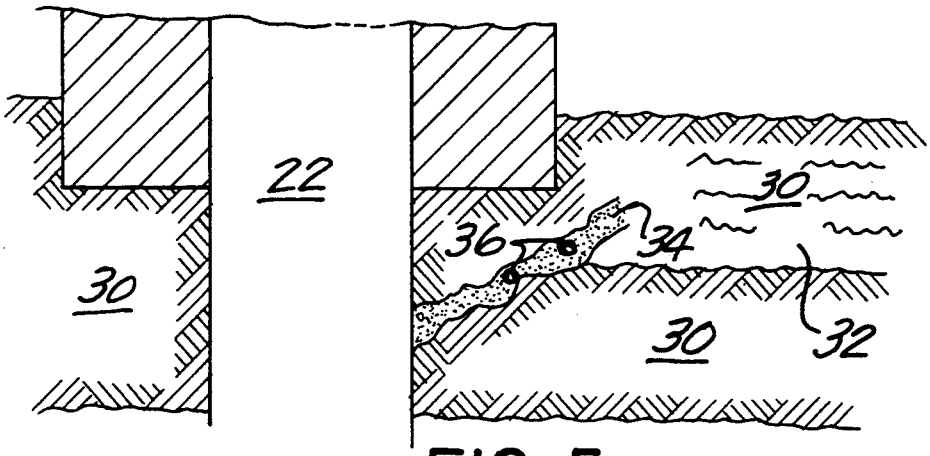
FIG. 5 is a fragmentary schematic side elevation of a fourth type of water well.
Figure 6:
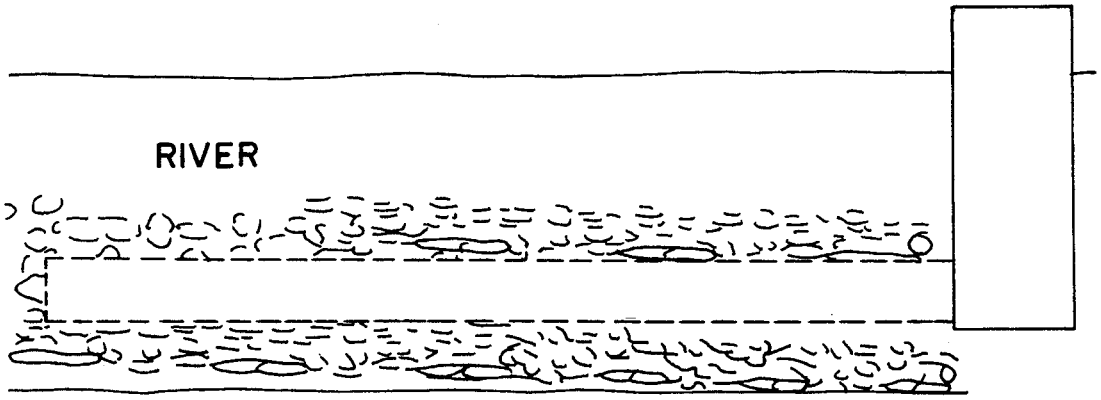
FIG. 6 is a fragmentary schematic side elevation of a fifth type of water well.
Figure 7A:
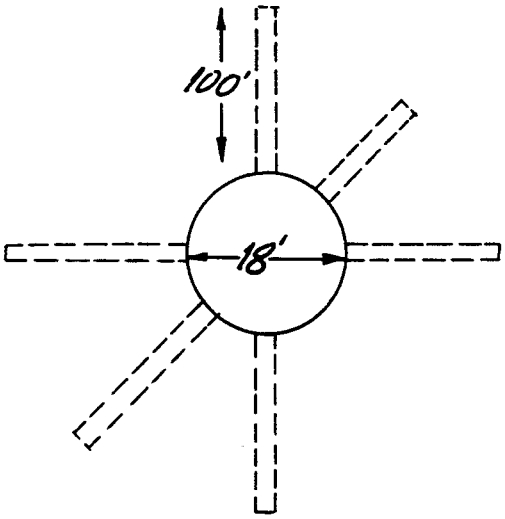
Figure 7B:
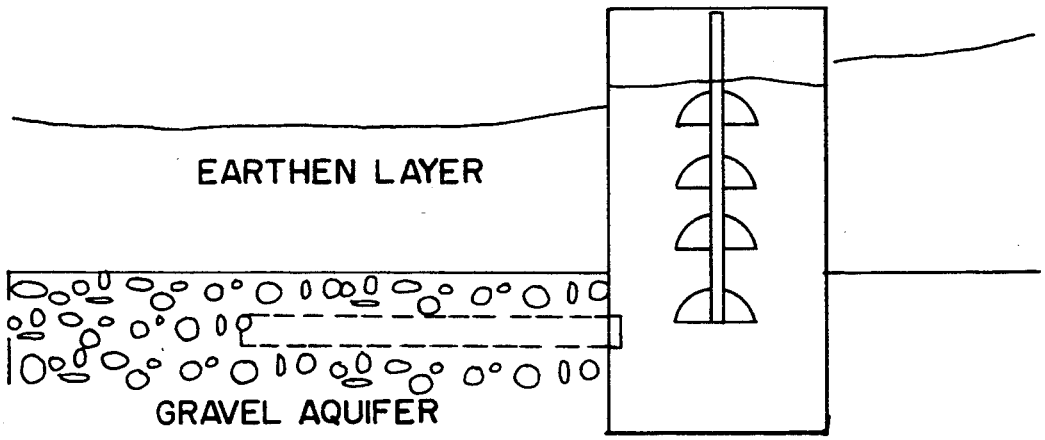

FIG. 4 and FIG. 5 illustrates the more usual type of formations found on the northeast seaboard. A number of stratified layers 30 of rock of different composition are found. Trapped among these rock layers are water aquifers 32 which may be natural wells where water has percolated up from lower levels and various well known types of aquifers. The interfaces between these layers 30 may provide passages for the trapped water 32 or the layers themselves may be fractured or contain weakened sections which can be turned into passages 34 to conduct water from the aquifers 32 through the side walls 26 and into the interior of the well 22. Wells in this type of formation are also subject to a decreased flow rate due to aging of the well or clogging. However, to ensure a smooth continuous flow of water from the aquifer 32 to the interior of the well 22 it is necessary that the natural passages such as 34 be enlarged and cleared of any fragmented rock, such as 36 loose soil, sand or similar materials which prevent or restrict the flow of water into well 22.

In addition to the well constructions described in the existing FIG. 2–5, FIG. 6 represents a horizontal well or infiltration gallery while FIGS. *7a* and *7b* represents a caisson well.

The present method comprises a method for stimulating the flow of water in a well. The method is not limited to any type of well and, in fact, the present method can be used to stimulate water flow in any known type of well. In contrast to prior procedures which utilized liquified gases and required cycled pressurization and depressurization to provide fractures in a well formation, the present method employs solid $CO_2$ and pressurization and depressurization to obtain fracturing is not required.

The present method comprises the steps of sealing the well and introducing liquid $CO_2$ into the sealed well at pressure such that the liquid $CO_2$ solidifies within the sealed well. Introduction of liquid $CO_2$ and solidification of the $CO_2$ in the well is continued until the desired and/or predetermined levels of filling of the well and/or formation is achieved. The sealed well containing the solidified $CO_2$ is allowed to stand. Freezing within the well begins with the liquid $CO_2$ injection because of the low temperature of the liquid $CO_2$. Further gradual freezing occurs because of the solidified $CO_2$ being added to the well as well as because of sublimed $CO_2$ formed from the solid $CO_2$ even during the addition procedure. Because of the temperature differential between the well formation and the solid $CO_2$, the solid $CO_2$ sublimates release gaseous $CO_2$ into the formation and consequently formation of carbonic acid ($H_2CO_3$) upon contact of the $CO_2$ with water in the formation. The presence of the carbonic acid in the well aids in the control of bacteria, especially iron-related bacteria, in the formation. In effect, a bactericidal effect can be achieved. Additionally, the present method aids because of the freezing within the well and well formation in removing mineral scaling and/or encrustation in the well, in the well formation and in the well screens. After sublimation of the $CO_2$, the residual pressure in the well is released and the seal removed. The freezing in the well because of the presence of solid $CO_2$ within the well leads to stimulation of water flow in the well.

If desired, the process can be repeated any number of times until the desired effect is achieved. Normally, two cycles are sufficient in obtaining the desired effect. In special circumstances, up to four cycles can be employed.

Prior to addition of liquid $CO_2$ and consequent formation of solid $CO_2$ (snow), the well can be purged with gaseous $CO_2$. Gaseous $CO_2$ can be discharged from the $CO_2$ storage vessel either from the vapor space of the vessel or from the vaporizer. Purging assures that all water has been displaced from all transport lines as well as from the area immediately below the well seal.

While the invention has been shown in only one of its forms, it is not thus limited, but is susceptible to various changes and modifications, without departing from the spirit of the invention.

We claim:

1. A method of stimulating a flow of water into a well from water pools in strata surrounding the well comprising the steps of: sealing the well in a manner such that pressurization of the well can be accomplished, introducing liquified carbon dioxide into the well at a down hole pressure such that the liquified carbon dioxide solidifies within the well forming solid carbon dioxide, continuing introduction of the liquid carbon dioxide into the well until a desired level of filling of the well with solid carbon dioxide is attained, allowing the sealed well containing solid carbon dioxide to stand for a time sufficient to sublime the solid carbon dioxide contained in the sealed well, releasing residual pressure in the sealed well and releasing the seal from the well.

2. The method according to claim 1, wherein sealing of the well comprises placing a sealing means on a casing of the well or in the well and securing the scalling means thereto.

3. The method according to claim 1, further comprising purging the sealed well with gaseous carbon dioxide prior to introduction of the liquid carbon dioxide.

4. The method according to claim 1, wherein the steps of the method are repeated a plurality of times in order to obtain the desired flow of water.

5. The method according to claim 1, wherein the down hole pressure is regulated so as to be within the range of between about 0 to 70 PSI.

6. The method according to claim 1, further comprising controlling or killing bacterial growth within the well.

7. The method according to claim 1, further comprising removing scale contained within the well.

8. The method according to claim 6, wherein sublimation of the solid $CO_2$ within the sealed well generates pressure within the sealed well and time releases carbonic acid into strata of the well.

9. The method according to claim 1, wherein the down hole pressure is sufficient to assure freezing of the water within the formation and surrounding strata.

* * * * *